US007184694B2

(12) United States Patent
Miho et al.

(10) Patent No.: US 7,184,694 B2
(45) Date of Patent: Feb. 27, 2007

(54) IMAGE FORMING METHOD AND APPARATUS TO MAINTAIN A HIGH EFFICIENCY OF TONER TRANSFER

(75) Inventors: Hiroaki Miho, Tokyo (JP); Satoshi Nishida, Tokyo (JP); Shigetaka Kurosu, Tokyo (JP); Masashi Saito, Tokyo (JP); Hiroshi Morimoto, Tokyo (JP)

(73) Assignee: Konica Corporation, Tokyo (JP)

( * ) Notice: Subject to any disclaimer, the term of this patent is extended or adjusted under 35 U.S.C. 154(b) by 808 days.

(21) Appl. No.: 10/303,126

(22) Filed: Nov. 22, 2002

(65) Prior Publication Data

US 2003/0123912 A1 Jul. 3, 2003

(30) Foreign Application Priority Data

Nov. 30, 2001 (JP) ..... 2001-366380

(51) Int. Cl.
*G03G 15/01* (2006.01)

(52) U.S. Cl. ..... 399/302; 399/303; 399/149; 399/142

(58) Field of Classification Search ..... 358/1.15; 399/302, 149, 313, 142
See application file for complete search history.

(56) References Cited

U.S. PATENT DOCUMENTS 5,729,805 A * 3/1998 Chiba et al. ..... 399/276
5,915,150 A * 6/1999 Kukimoto et al. ..... 399/149
5,998,080 A * 12/1999 Ohno et al. ..... 430/108.4
6,841,328 B2 * 1/2005 Shirose et al. ..... 430/124

FOREIGN PATENT DOCUMENTS

JP 2001-318482 A 11/2001

* cited by examiner

*Primary Examiner*—Kimberly Williams
*Assistant Examiner*—Andrew Lam
(74) *Attorney, Agent, or Firm*—Frishauf, Holtz, Goodman & Chick, P.C.

(57) ABSTRACT

An image forming apparatus having: an image forming body for forming a latent image and a toner image; a developing device for developing with a toner the latent image formed on the image forming body to form the toner image; a primary transfer device for transferring the toner image on the image forming body onto an intermediate transfer body; and a secondary transfer device for transferring the toner image on the intermediate transfer body onto an image support. The primary transfer device has conductive body or semi-conductive body, and is provided with a power supply unit for applying a bias voltage. It is characterized in that the variation coefficient of the shape factor of the toner is 16% or less, and the number variation coefficient of the number particle size distribution of the toner is 27% or less.

16 Claims, 3 Drawing Sheets

IMAGE FORMING METHOD AND APPARATUS TO MAINTAIN A HIGH EFFICIENCY OF TONER TRANSFER

BACKGROUND OF THE INVENTION

The present invention relates to an image forming apparatus used in a copying machine and a printer.

Nowadays, in an image forming apparatus wherein a high speed and high image quality are required, there is employed, in most cases, an image forming method of an electrostatic latent image system with an electrophotographic system as a central system.

The reason for the foregoing is that an image with high image quality can be obtained at high speed and stably, and the aforementioned image forming method can be applied also to forming a color image and a digital image. It is therefore conceivable that the image forming method of an electrostatic latent image system may keep holding its great ground even in the future.

However, a level of demands from the field for the image forming technology is high, and it is going up year after year. Therefore, further progress of ability is demanded also in the electrostatic latent image system.

Among the aforesaid demands, the greatest one is further improvement of image quality as a matter of course, and as a measure for the demand, it is effective to make toner to be of a small particle size and to uniform the particle size distribution and particle shapes. However, it causes another problem, in many cases, to make toner to be a small particle and to uniform the particle distribution and particle shapes. Without taking any actions to these problems, practical use of them is difficult.

There has been a limit for enhancing a transfer rate without causing an image defect, and this is more tendentious when there are used toner of a small particle size and toner of uniformed distribution of particle sizes and uniformed particle shapes. If the transfer rate is lowered when a superposed color image is made by using plural photoreceptors and by transferring successively a monochrome image formed by each photoreceptor to superpose it, there are caused not only a fall of image density but also a disturbance of color balance, which is a serious problem. Further, for forming a color image, there are many modes wherein an intermediate transfer body is used, and transfer is conducted twice, including primary transfer to the intermediate transfer body and secondary transfer from the intermediate transfer body to the image support. In this case, an influence on the transfer rate is serious.

In order to avoid the aforementioned problems, it is necessary to find out a method wherein sufficient transfer rate can be obtained, even if a superposed color image is formed by transferring, plural times, a toner image made by small particle size toner in which particle size distribution and particle shapes are uniform, and even if the color images are transferred collectively.

The invention has been achieved to solve the aforementioned problems, and to further solve the following problems which cannot be ignored when developing a color image forming apparatus which is actually of a tandem type.

In the color image forming apparatus of a tandem type, it is necessary that plural toner images are transferred to be superposed on an intermediate transfer body or on an image support (both of these items are sometimes called collectively a transfer material), and when a toner image is further transferred newly on a toner image which has already been transferred on a transfer material, there must be selected a condition that the toner image to be transferred newly is transferred at a high transfer rate, and toner which has already been transferred is not transferred again onto the photoreceptor. Further, if a scratch is caused on an image forming body or an intermediate transfer body, toner tends to be stuck to the scratch, and its range is broadened gradually, resulting in toner filming. It is therefore important not to cause a scratch.

In most of transfer means for transferring toner images, there is used a transfer roller on which bias voltage is applied for transferring. In the case of forming images at high speed as in the present time, a value of an electric current for transfer per unit time tends to be high because transfer speed (moving speed) for a transfer material is also high and transfer time is short accordingly. Voltage that is necessary for transfer and is applied on a transfer roller is also high, and exfoliation discharge is generated when an image forming body leaves a transfer material, thus, transfer unevenness and toner repelling tend to be caused. It is therefore necessary to keep a value of an electric current for transfer per unit time down as far as possible even when the transfer time is short.

Further, owing to toner scattering or jamming of an image support, toner sometimes sticks to the transfer roller which, therefore, needs to be cleaned. As a cleaning method, if bias voltage which is opposite to that for transferring is applied to return toner to an intermediate transfer body or an image forming body once, and to collect the toner with a cleaning means, the transfer roller does not need to be provided with a cleaning means, which is preferable on the points of cost and space saving. However, for that purpose, characteristics of toner need to be improved so that reverse transfer may be carried out sufficiently.

Namely, objects of the invention are to keep the transfer efficiency for toner to be high for a long time and to find out measures for solving the following problems.

The first object is to find out conditions that a toner image to be transferred on a transfer material newly is transferred at the high transfer rate and another toner image which has already been transferred is not transferred again on an image forming body, when further transferring the toner image on another toner image which has already been transferred on a transfer material, and to provide an image forming apparatus wherein surfaces of an image forming body and of an intermediate transfer body are not scratched, and neither cleaning trouble nor toner filming is caused.

The second object is to provide an image forming apparatus wherein the process speed for transferring toner images is high, and high transfer efficiency can be obtained even when a value of an electric current to be impressed on a roller to prevent exfoliation discharge is lowered.

The third object is to provide an image forming apparatus wherein it is possible to return toner to an image carrier or to an intermediate transfer body by applying reverse bias voltage for the purpose of cleaning a transfer means, and to clean for certain.

SUMMARY OF THE INVENTION

The inventors of the invention found out, after their intensive studies, that the object of the invention can be attained by employing either one of the following structures.

Structure (1)

An image forming apparatus having therein an image forming body, a developing means for developing latent images on the image forming body, a primary transfer means that transfers a toner image formed on the image forming body onto an intermediate transfer body, and a secondary transfer means that transfers the toner image on the intermediate transfer body onto an image support, wherein the primary transfer means is conductive or semi-conductive and is provided with a power supply unit that applies bias voltage, and a variation coefficient of a shape factor of the toner stated above is 16% or less, and a variation coefficient of number particle size distribution is 27% or less.

Structure (2)

The image forming apparatus according to Structure (1) wherein a particle number average particle diameter of the toner stated above is 2–7 μm.

Structure (3)

The image forming apparatus according to Structure (1) wherein a volume resistivity of the intermediate transfer body is $10^3$–$10^{13}$ Ω·cm.

Structure (4)

The image forming apparatus according to Structure (1) wherein toner images each being different in terms of color from others are transferred to be superposed on the intermediate transfer body.

Structure (5)

The image forming apparatus according to Structure (1) wherein the developing means is a two-component developing unit, and two -component developing agent in which toner and carrier are mixed is used for developing.

Structure (6)

The image forming apparatus according to Structure (1) wherein the primary transfer means is an elastic roller, which comprises an elastic body mounted on a core metal, and is impressed with bias voltage.

Structure (7)

An image forming apparatus having therein plural primary transfer means, which have plural image forming bodies and transfer a toner image formed by developing a latent image on each image forming body with toner with corresponding developing means by superposing color images successively on the same intermediate transfer body, and a secondary transfer means that collectively transfers toner images on the intermediate transfer body onto an image support, wherein the conveyance speed for the intermediate transfer body in the course of the primary transfer is 200 mm/s or more, the number average particle size of the toner for all of them is 2–7 μm, and a variation coefficient is 27% or less.

Structure (8)

The image forming apparatus according to Structure (7) wherein the sum (M) of relative frequency (m1) of toner particle included in a most frequent rank and relative frequency (m2) of toner particle included in the rank that is second highest to the most frequent rank in the histogram showing particle size distribution of the number basis wherein the horizontal axis representing natural logarithm InD is divided into plural ranks at 0.23 intervals is 70% or more.

Structure (9)

The image forming apparatus according to Structure (7) wherein the number basis ratio of toner particles, whose shape factor of toner is in a range of 1.2–1.6, is 65% or more, and a coefficient of variation of the shape factor is 16% or less.

Structure (10)

An image forming apparatus having therein image forming bodies for respective colors of yellow (Y), magenta (M), cyan (C) and black (K), developing means each developing a latent image formed on each image forming body with each color toner corresponding to that latent image, primary transfer means for respective colors each transferring a toner image of each color formed on the image forming body on the same intermediate transfer body to be superposed successively, and a secondary transfer means that transfers collectively the superposed toner images formed on the intermediate transfer body onto an image support, wherein each particle number average particle diameter for each color toner is 2–7 μm, and its variation coefficient is 27% or less, while, a transfer roller is used for the secondary transfer means and a cleaning method to transfer toner again onto the intermediate transfer body by means of electric field is used for cleaning the roller.

Structure (11)

An image forming apparatus having therein image forming bodies for respective colors of yellow (Y), magenta (M), cyan (C) and black (K), developing means each developing a latent image formed on each image forming body with each color toner corresponding to that latent image and transfer means for respective colors each transferring each color toner image formed on the image support to be superposed successively, wherein particle number average particle diameter for respective color toners is 2–7 μm, its variation coefficient is 27% or less, while, a transfer roller is used for the transfer means and a cleaning method to transfer toner again onto the image forming body by means of electric field is used for cleaning the roller.

Structure (12)

The image forming apparatus according to Structure (10) or Structure (11) wherein the sum total (M) of relative frequency (m1) of toner particles included in a most frequent rank and relative frequency (m2) of toner particles included in the rank that is second highest to the most frequent rank in the histogram showing particle size distribution of the number basis wherein the horizontal axis representing natural logarithm InD is divided into plural ranks at 0.23 intervals is 70% or more.

Structure (13)

The image forming apparatus according to Structure (10) or Structure (11) wherein the number basis ratio of toner particles in which the shape factor of the toner is in a range of 1.2–1.6 is 65% or more, and a variation coefficient of the shape factor is 16% or less.

Incidentally, each of a group of the inventions in the Structures (1)–(6), a group of the inventions in the Structures (7)–(9) and a group of the inventions in the Structures (10)–(13) stated above is different from other groups in terms of structure. Therefore, the invention having the structure of (1)–(6) may sometimes be called the first invention, the invention having the structure of (7)–(9) may sometimes be called the second invention and the invention having the structure of (10)–(13) may sometimes be called the third invention.

Further, the intermediate transfer body is one which carries transiently a toner image formed by toner development, and polyimide resin, silicon rubber or the one wherein silicon rubber is coated on a resin film that does not expand and contract are usually used. It is preferable that its volume resistivity is $10^3$–$10^{13}$ Ω·cm.

The image support is a carrier for the final image, and it usually is a plain paper or a converted paper. Incidentally, these intermediate transfer body and image support my be generically called a transfer material. Further, the image forming body which will be described later is typically an electrophotographic photoreceptor.

As a transfer means in the invention, both the first transfer means and the second transfer means are of a type wherein a transfer material is brought into pressure contact with a toner image, and its typical one is a transfer roller.

It is general that the transfer roller is one wherein elastic rubber or resin is wound round a core metal representing a roller shaft, and there further is one wherein the aforesaid transfer roller is covered by a thin resin layer. The roller shaft may also be made of resin if there is no problem of capacity such as strength, and the quality of the material of those wound round the roller shaft is not limited in particular. When impressing bias voltage, however, the quality of the material needs to be conductive or semi-conductive, and volume resistivity is preferably $10^3$–$10^{13}$ ∩·cm. Power supply for applying bias voltage on a transfer means is a high voltage power supply, and it sometimes is a bias power supply wherein A.C. is superimposed on D.C.

Other matters will be explained in the latter stage.

DETAILED DESCRIPTION OF THE PREFERRED EMBODIMENT

First, a mechanism of a typical image forming apparatus used in all of the present invention is shown for illustrating the invention concretely.

Figure 1:
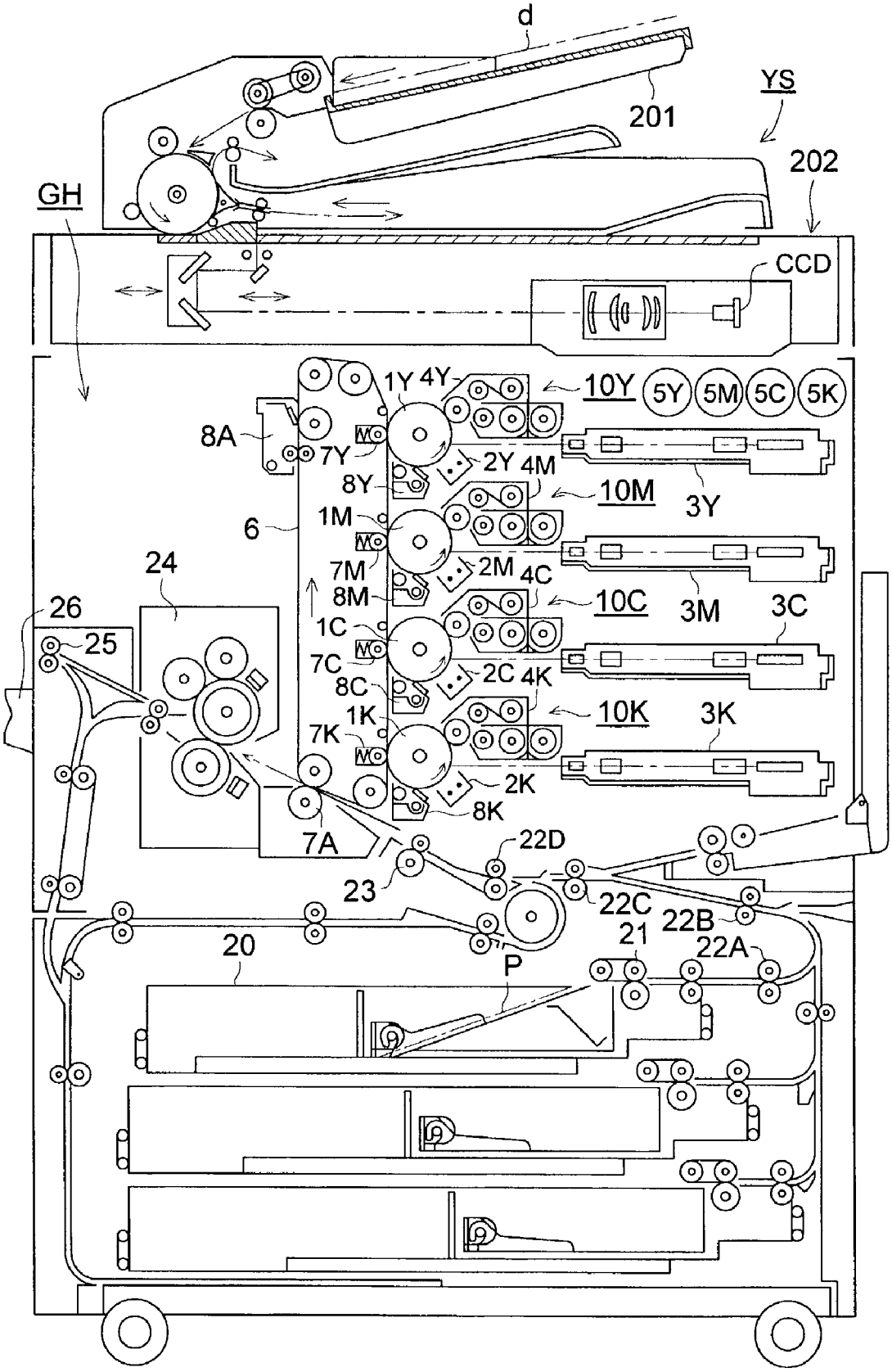
FIG. 1 is a sectional view for illustrating the structure of a color copying machine representing an example of an image forming apparatus related to an embodiment of the invention.

FIG. 1 is a sectional view for illustrating the structure of a color copying machine representing an example of an image forming apparatus relating to an embodiment of the invention.

Image forming apparatus main body GH shown in FIG. 1 is one called a color image forming apparatus of a tandem type, and it has therein plural sets of image forming sections 10Y, 10M, 10C and 10K, belt-shaped intermediate transfer body 6, sheet feeding and conveying means and fixing unit 24.

Image forming section 10Y for forming a yellow image has therein charging means 2Y arranged around photoreceptor 1Y representing an image forming body, image-wise exposure means 3Y, toner-developing means 4Y and cleaning means 8Y. Image forming section 10M for forming a magenta image has therein photoreceptor 1M representing an image forming body, charging means 2M, image-wise exposure means 3M, toner-developing means 4M and cleaning means 8M. The same structure as the foregoing is applied also to image forming section 10C that forms a cyan image and to image forming section 10K that forms a black image.

Each of combination of charging means 2Y and image-wise exposure means 3Y, combination of charging means 2M and image-wise exposure means 3M, combination of charging means 2C and image-wise exposure means 3C and combination of charging means 2K and image-wise exposure means 3K constitutes a latent image forming means.

Intermediate transfer body 6 is an endless belt, and it is trained about plural rollers to be supported rotatably.

A color image of each color formed by each of image forming sections 10Y, 10M, 10C and 10K is transferred onto rotating intermediate transfer body 6 by each of transfer bodies (transfer rollers) 7Y, 7M, 7C and 7K in succession to complete primary transfer, and thus, a color image of a superposition type is formed.

Image support P contained in sheet feed cassette 20 is fed by sheet feed means 21, and is conveyed to transfer means 7A through sheet feed rollers 22A, 22B, 22C and registration roller 23, and thereby, a color image of a superposition type is formed (secondary transfer). The image support P on which the color image has been transferred is subjected to fixing processing conducted by fixing unit 24 and is interposed by sheet ejection rollers 25 to be ejected on sheet ejection tray 26 located outside the apparatus.

On the other hand, the intermediate transfer body 6 from which the image support P has been separated after the color image was transferred from the intermediate transfer body 6 to the image support P by the transfer means 7A is cleaned by cleaning means 8A so that residual toner may be removed.

Incidentally, each of 5Y, 5M, 5C and 5K is a toner supply means that supplies fresh toner to each of toner-developing means 4Y, 4M, 4C and 4K.

On the top of image forming apparatus main body GH, there is arranged image reading device YS which is composed of automatic document feeder 201 and document image scanning exposure device 202. Document "d" placed on a document table of the automatic document feeder 201 is conveyed by a conveying means, and thereby, images on one side or both sides of the document are subjected to scanning exposure by an optical system of the document image scanning exposure device 202 to be read in line image sensor CCD.

Analog signals converted photoelectrically by line image sensor CCD are subjected to analog processing, A/D conversion, shading correction and image compression processing in the image processing section, and signals are sent to each of image writing sections (image-wise exposure means) 3Y, 3M, 3C and 3K.

The automatic document feeder 201 is provided with an automatic two-sided document conveying means. Since the automatic document feeder 201 can read, continuously and by one effort, the contents of a large number of documents d fed from the document table, and can accumulate in a storage means (electronic RDH function), it is used conveniently when copying contents of a large number of documents by copying functions, or when transmitting a large number of documents d by facsimile functions.

Next, there will be explained as follows, regarding toner used in the invention and its shape or other essential factors.

1. Image Forming Body

A typical image forming body in the invention is an electrophotographic photoreceptor (which may be simply called a photoreceptor). It may be either an organic photoreceptor or an inorganic photoreceptor, and there is no limitation, if it is the so-called electrophotographic photoreceptor. However, what is used most commonly in recent years is an organic photoreceptor (OPC).

With respect to the organic photoreceptor, there is used an organic photoreceptor of a laminated type wherein phthalocyanine pigment or perylene pigment is usually used as a charge-generating substance, and fine particles of the pigment are dispersed in resin and coated to form a charge-generating layer, and trimethylamine compounds are used as a charge transfer substance and are coated together with resin to form a charge transfer layer.

2. Charging Means, Image-Wise Exposure Means, Developing Means

Those used normally in an image forming apparatus of an electrophotographic system are also used in the invention.

Namely, as a charging means (a means for charging a photoreceptor uniformly, in this case), there are given a corotron, a corona charging unit of a scorotron type, a roller charging unit and a brush charging unit.

As an image-wise exposure means, a semiconductor laser light source and an LED light source are used, and a photoreceptor surface charged uniformly is subjected to image-wise exposure conducted by beam-shaped or spot-shaped light emitted from the light source, so that a latent image may be formed on that surface.

The developing means may be either a developing means of a single-component developing mode or a developing means of a two-component developing mode, and these have only to be a developing unit which can use developing agents explained later.

3. Toner Used in the Invention

The invention is for solving aforementioned problems caused in an image forming apparatus in the course of transferring, by using toner wherein a particle size is small, particle size distribution is narrow and a shape is uniform and by transferring with an excellent transfer efficiency.

When a particle diameter of toner to be used is evaluated to be small, it concretely means toner whose particle number average particle diameter is 2–7 μm, and this is an essential factor in the second and third inventions of the present invention, and toner in this range is also preferable for the first invention. The more preferable is 3–6 μm. If the average particle diameter is less than 2 μm, charging is not carried out sufficiently, and there is a possibility that image quality deterioration and adverse affect on a human body are caused by toner scattering, which is disadvantageous also on the point of production efficiency. If the average particle diameter exceeds 7 μm, the problems in the course of transfer stated above cannot be solved, or there is a possibility that the aforementioned problems cannot be solved.

Next, toner shapes in the invention will be explained in detail.

Toner used in the first invention in the present invention is composed of toner particles wherein a variation coefficient of its shape factor is 16% or less, and a number variation coefficient in a number particle size distribution is 27% or less. Further, in the second and third inventions, toner used therein is composed of toner particles wherein a number variation coefficient in the number particle size distribution is 27% or less.

If this range is kept, presence of external additives on the toner surface is uniform, and charge amount distribution turns out to be sharp and high fluidity is obtained.

Since the charge amount remains even for each toner particle, toner particles, which equally react to developing field, increase to improve the developing efficiency. Further, external additives remained in the developing unit are not easily embedded in the surface of the toner particles, therefore, toner particle with embedded additives is rarely developed.

As a result, a process speed for image forming can be increased, and conveyance speeds for an image forming body, an intermediate transfer body, an image support and a transfer roller are increased, thus, transfer is carried out surely in an excellent transfer efficiency even when the transfer time is shortened.

Regarding the transfer efficiency, even in the cases where transfer time is shortened due to the increase of the process speed, since the toner particles developed on the image forming body have even charge amount, and the toner particles are not embedded with external additives, the van der Waal's adsorption force between the developed toner and the image forming body remains small, this results in excellent transfer efficiency.

It is further possible to prevent that electric charges are concentrated on a projection portion of a toner particle in the course of transferring, and dielectric breakdown is caused in a narrow space between a photoreceptor and an intermediate transfer body. Thus, the photoreceptor and the intermediate transfer body are hardly damaged.

Further, in the second and third inventions in the present invention, it was found that embedding of external additives is not caused and charge amount distribution turns out to be sharp, resulting in good influence, even when toner shapes are made uniform as a specific shape. Namely, it was found that measures for transfer failure in high speed image forming and characteristics in cleaning by reverse bias transfer for a transfer roller are improved by using toner wherein a number basis ratio of toner particles whose shape factor is in a range of 1.2–1.6 is 65%, and a variation coefficient of the shape factor is 16% or less.

Now, number particle size distribution and a number variation coefficient of toner of the invention will be explained. The number particle size distribution and a number variation coefficient of toner of the invention are those measured by Coulter Counter TA-II or by Coulter Multisizer (both are made by Coulter Scientific Japan Co.). In the present invention, Coulter Multisizer was used after being connected to an interface (made by Nikkaki-bios Co.) that outputs particle size distribution and to a personal computer. AS an aperture to be used in Coulter Multisizer, particle number particle diameters were measured by using those of 100 μm to calculate particle size distribution and an average particle diameter. The number particle size distribution is one indicating a relative frequency of toner particle to the particle diameter, and a number average particle diameter is one for indicating a diameter of accumulation 50% in the number particle size distribution, namely, indicating Dn50.

The number variation coefficient in the number particle size distribution of toner is calculated from the following expression.

$$\text{Number variation coefficient}=(S/Dn)\times 100\ (\%)$$

(In the expression, S represents a standard deviation in the number particle size distribution and Dn represents number average particle diameter (μm).)

The number variation coefficient of toner of the invention is 27% or less, and it preferably is 25% or less. When the number variation coefficient is 27% or less, a gap in a toner layer transferred is reduced, and charge amount distribution turns out to be sharp and transfer efficiency is enhanced.

Next, a shape factor of toner of the invention will be explained. In the toner, a number basis ratio of toner particles whose shape factor is in a range of 1.2–1.6 is 65% or more, and a variation coefficient of the shape factor is 16% or less. In this case, the shape factor of toner of the invention is expressed by the following expression, and it shows a degree of sphericity of a toner particle.

$$\text{Shape factor}=((\text{maximum diameter}/2)^2\times\pi)/\text{projected area}$$

Here, the maximum diameter means a width of a particle which makes a distance between two parallel lines to be maximum when a projected image of a toner particle on a plane is interposed by the two parallel lines. Further, the projected area is an area of the projected image of a toner particle on a plane.

The variation coefficient of the shape factor of toner is calculated from the following expression.

$$\text{Variation coefficient}=(S1/K)\times 100\ (\%)$$

(In the expression, S1 represents a standard deviation in the shape factor of 100 toner particles, and K represents an average value of the shape factor.)

In the invention, the shape factor was obtained through measurement by photographing a photo of a toner particle magnified by a scanning type electron microscope 2000 times, and by analyzing a photographic image by using "SCANNING IMAGE ANALYZER" (made by NIHON DENSHI CO.) based on the photograph stated above. In this case, 100 pieces of toner particles were used to obtain the shape factor of the invention through measurement by the above-mentioned calculation expression.

Further, with respect to toner in the second and third inventions in the present invention, the preferable is toner wherein the total (M) of relative frequency (m1) of toner particles included in the most frequent rank and relative frequency (m2) of toner particles included in the second highest frequency rank to the most frequent rank is 70% or more in the histogram showing the particle size distribution on a number basis in which a natural logarithm 1nD is taken as a horizontal axis when D (μm) represents a particle diameter of a toner particle, and this horizontal axis is divided into plural ranks at the interval of 0.23.

When the total (M) of relative frequency (m1) and relative frequency (m2) is 70% or more, dispersion of the particle size distribution of toner particles turns out to be narrow, and thereby, occurrence of selective developing can surely be controlled by using the toner in the image forming process.

In the invention, the histogram showing the particle size distribution on a number basis is a histogram showing the particle size distribution on a number basis wherein a natural logarithm 1nD (D: particle diameter of each toner particle) is divided into plural ranks (0–0.23: 0.23–0.46: 0.46–0.69: 0.69–0.92: 0.92–1.15: 1.15–1.38: 1.38–1.61: 1.61–1.84: 1.84–2.07: 2.07–2.30: 2.30–2.53: 2.53–2.76 . . . ) at the interval of 0.23. This histogram is one prepared by a program of particle size distribution analysis, in a computer to which particle diameter data of samples measured by Coulter Multisizer under the following conditions are transferred through I/O unit.

(Measurement Conditions)

1. Aperture: 100 μm
2. Sample preparation method: An appropriate amount of surfactant (neutral detergent) is added to an electrolyte (ISOTON II (made by Coulter Scientific Japan Co.)) of 50–100 ml in volume to be stirred, and a sample of 10–20 mg in weight for measurement is added to the electrolyte. The foregoing is dispersed by an ultrasonic homogenizer for one minute to prepare the sample.

4. Manufacturing Method for Toner

A manufacturing method for toner related to the invention is not limited in particular, and it is preferable to employ the so-called polymerization method that forms toner particles in the course of polymerization reaction, without conducting kneading, grinding and classification, because it is easy to make toner in which a particle diameter is small, a particle size distribution is narrow and particle shapes are uniform.

For example, it is possible to manufacture through a suspension polymerization method and a method wherein polymerization fine particles are made by emulsion-polymerizing a monomer in a solution including an emulsified liquid of necessary addition agents, and then, an organic solvent and flocculating agents are added for coagulation. There are given a method to prepare through coagulation by mixing, in the case of coagulation, with a dispersion solution including releasing agents necessary for composing toner and coloring agents, and a method to emulsion-polymerize after dispersing constituent components for toner such as releasing agents and coloring agents in a monomer. Coagulation in this case means that a plurality of resin particles and a plurality of coloring agent particles stick each other.

In the suspension polymerization method, polymeric monomers where various constituent materials are dissolved or dispersed are dispersed to be a drop of oil in a desired size as toner in an aqueous medium containing dispersion stabilizing agents, by the use of a homomixer or a homogenizer. After that, the contents are put in a reaction vessel having a stirring mechanism, and are heated so that polymerization reaction may be advanced. After the reaction is completed, dispersion stabilizing agents are removed, and toner related to the invention is prepared through filtering, washing and drying.

As a manufacturing method for toner related to the invention, there is also given a method to prepare by coagulating or sticking resin particles made through emulsion polymerization, in aqueous medium. As this method, there is no limitation in particular, and there are given some methods shown, for example, in TOKKAIHEI Nos. 5-265252, 6-329947 and 9-15904.

In the method to coagulate a plurality of dispersion particles of constituent materials such as resin particles and coloring agents and a plurality of fine particles constituted by resins and coloring agents, in particular, in the method wherein, after dispersing the foregoing in water by the use of emulsifying agents, coagulating agents having density equal to or higher than the critical coagulation density are added to be salted-out, then, a particle diameter is made to grow gradually while heating at temperature that is not less than glass transition temperature of the formed polymer itself and thereby forming sticking particles, then, particle diameter growth is stopped by adding a large amount of water at the moment of obtaining the target particle diameter, and a shape is controlled by smoothing particle surface while heating and stirring further, to heat and dry the particles under the state of fluidity while the particles are in the moisture-containing state, it is possible to form toner related to the invention. Incidentally, in this case, an organic solvent that dissolves in water infinitely may also be added together with coagulating agents.

For those used as polymeric monomer constituting resin, styrene, methacrylic acid ester, acrylic ester and olefins can be used independently or in combination.

Although the toner in the invention contains therein at least resins and coloring agents, it can also contain releasing agents representing fixability improving agents and charge control agents. Further, the toner may also be one wherein additives composed of inorganic fine particles and organic fine particles are added to toner particles having the aforementioned resins and coloring agents as main components.

As a coloring agent used for toner in the invention, carbon black, magnetic particles, dyes or pigments can be used optionally, and as carbon black, channel black, furnace black, acetylene black, thermal black and lamp black are used. As magnetic particles, ferromagnetic metal such as iron, nickel and cobalt, alloy including these metals, compounds of ferromagnetic metals such as ferrite and magnetite, alloy which does not contain ferromagnetic metal but shows ferromagnetism after heat treatment, for example, alloy called Heusler's alloy such as manganese-copper-aluminum and manganese-copper-tin, and chromium dioxide can be used.

As a dye, it is possible to use C. I. Solvent Red 1, C. I. Solvent Red 49, C. I. Solvent Red 52, C. I. Solvent Red 58, C. I. Solvent Red 63, C. I. Solvent Red 11 and C. I. Solvent Red 122, C. I. Solvent Yellow 19, C. I. Solvent Yellow 44, C. I. Solvent Yellow 77, C. I. Solvent Yellow 79, C. I. Solvent Yellow 19, C. I. Solvent Yellow 44, C. I. Solvent Yellow 77, C. I. Solvent Yellow 79, C. I. Solvent Yellow 81, C. I. Solvent Yellow 82, C. I. Solvent Yellow 93, C. I. Solvent Yellow 98, C. I. Solvent Yellow 103, C. I. Solvent Yellow 104, C. I. Solvent Yellow 112 and C. I. Solvent Yellow 162, C. I. Solvent Blue 25, C. I. Solvent Blue 36, C. I. Solvent Blue 60, C. I. Solvent Blue 70, C. I. Solvent Blue 93 and C. I. Solvent Blue 95, and to use a mixture of the foregoing. As a pigment, it is possible to use C. I. Pigment Red 5, C. I. Pigment Red 48:1, C. I. Pigment Red 53:1, C. I. Pigment Red 57:1, C. I. Pigment Red 122, C. I. Pigment Red 139, C. I. Pigment Red 144, C. I. Pigment Red 149, C. I. Pigment Red 156, C. I. Pigment Red 177, C. I. Pigment Red 178, C. I. Pigment Red 222, C. I. Pigment Orange 31 and C. I. Pigment Orange 43, C. I. Pigment Yellow 14, C. I. Pigment Yellow 17, C. I. Pigment Yellow 93, C. I. Pigment Yellow 94 and C. I. Pigment Yellow 138, C. I. Pigment Green 7, C. I. Pigment Blue 15:3 and C. I. Pigment Blue 60, and to use a mixture of the foregoing. Though the number average primary particle diameter varies depending on types, a diameter of about 10–200 μm is preferable.

5. Developing Agents and Developing Conditions

Next, developing agents and developing conditions both used in the invention will be explained as follow.

Toner used in the invention may be used as either single-component developing agents or two-component developing agents, but it is used preferably as two-component developing agents.

Then using as single-component developing agents, the toner is used as it is as nonmagnetic single-component developing agents in a certain method, but it is normally used as magnetic single-component developing agents by making toner particles to contain magnetic particles each being of a size of about 0.1–5 μm. In a method of containing the magnetic particles, it is normal that the magnetic particles are contained in a nonspherical particle in the same way as in coloring agents.

It is further possible to use preferable as two-component developing agents by mixing with carriers. In this case, there are used materials which have been known widely including metals such as iron, ferrite or magnetite, and alloys of the aforesaid metals and a metal such as aluminum or lead, as magnetic particles of carriers. The ferrite particle is preferable in particular. The magnetic particles stated above have a volume average particle diameter of 15–100 μm, and those having a volume average particle diameter of 25–60 μm are more preferable.

A volume average particle diameter for carriers can be measured by a particle size distribution measuring instrument of a laser diffraction type "HELOS" (made by SYMPATEC Co.).

Regarding carriers, those wherein each magnetic particle is further covered by resin, or carriers of a resin dispersion type wherein magnetic particles are dispersed in resin are preferable. Although there is no limitation for the composition of resin for coating, in particular, olefin type resin, styrene type resin, styrene acryl type resin, silicon type resin, ester type resin or fluorine-containing polymer type resin, for example, is used. Further, as resin for constituting carriers of a resin dispersion type, known resins can be used without being limited in particular, and styrene acryl resin, polyester resin, fluorine type resin and phenol resin, for example, can be used.

Further, with respect to a developing method, either a contact type developing method or a non-contact type one can be used. When the non-contact type developing method is employed, it is possible to conduct non-contact regular developing or non-contact reversal developing. The D.C. developing electric field in that case is $1\times10^3$–$1\times10^5$ V/cm in the absolute value, and it preferably is $5\times10^3$–$1\times10^4$ V/cm, and when it is less than $10^3$ V/cm, developing turns out to be insufficient and sufficient image density cannot be obtained, resulting in inability for obtaining sufficient image density, while, when it exceeds $10^5$ V/cm, image quality is roughened and photographic fog is caused.

A. C. bias voltage is made to be 0.5–4 kV (p—p), and preferably to be 1–3 kV (p—p), and frequency is made to be 0.1–10 kHz, and preferably to be 2–8 kHz. When A. C. bias voltage is less than 0.5 kV (p—p), toner sticking to carrier is not removed from the carrier to make non-contact developing insufficient and to make image density insufficient. When A. C. bias voltage exceeds 4 kV (p—p), carriers in developing agents fly to stick to a photoreceptor. If frequency of A. C. bias voltage is less than 0.1 kHz further, removal of toner from carrier becomes insufficient to cause insufficient developing and a decline of image density. When the frequency of A. C. bias voltage exceeds 10 kHz, toner cannot follow the fluctuation of the electric field, resulting in developing failure and a decline of image density.

6. Other Structures

As an appropriate fixing method used in the invention, the so-called heating method of a contact type can be given. In particular, a heat pressure fixing method, further, a heat roller fixing method and a pressure contact heating fixing method wherein fixing is conducted by a rotating pressing member that houses a heating body that is fixedly arranged.

An image forming apparatus of the invention can generally be applied to an electrophotographic apparatus such as a copying machine, a laser printer, an LED printer and a liquid crystal shutter type printer, and it can further be applied widely to apparatuses for display, recording, short-run printing, plate-making and facsimile.

Next, for giving a further explanation about the structures and effects of the invention, there will be shown practical embodiments, to which, however, the structures of the invention are not limited.

EXAMPLE 1

Following evaluations were made by using the color copying machine shown in FIG. 1.

Each photoreceptor has a diameter of 60 mm, and for a lightsensitive layer of the photoreceptor, polycarbonate in which phthalocyanine pigment is dispersed was used, and a layer having the total thickness of 25 μm including a charge transfer layer was used. Every photoreceptor was adjusted to 600 V for non-exposure area voltage and to 50 V for exposure area voltage, and a semiconductor laser light source (300 μW) was used for image-wise exposure, and development was conducted by the two-component developing method.

There was used toner wherein a particle number average particle size thereof was 6 μm for all colors of Y, M, C and K, but, a variation coefficient was slightly different depending on each color, and a variation coefficient of a shape factor was within a range of 12–16%, and a variation coefficient of a number particle size distribution was in a range of 20–24%.

The conveyance speed of the intermediate transfer body was made to be 180 mm/s, and a seamless semiconductive resin belt ($10^8$ Ω·cm) was used. Further, for the means of transferring (primary transferring) from each photoreceptor to the intermediate transfer body, a roller made of foaming resin ($10^6$ Ω·cm) having a diameter of 20 mm was provided on the back side of the intermediate transfer body, and constant-current was controlled to 20 μA.

As a means of transferring (secondary transferring) from the intermediate transfer body to an image support (plain paper), a semiconductor roller was pressed against the intermediate transfer body from the back side of a plain paper, and constant-current was controlled to 80 μA.

A heater was arranged inside the fixing means (unit), and a heating roller and a pressure roller were used.

Practical copy tests were conducted up to 200,000 copies. In the first half, 100,000 copies were made under the conditions of ordinary temperature and ordinary humidity (20° C., 50% RH), then, succeeding 50,000 copies were made under the conditions of low temperature and low humidity (10° C., 20% RH), and the following 50,000 copies were made under the conditions of high temperature and high humidity (30° C., 80% RH).

Highest image density is absolute density obtained by a reflection densitometer, and a transfer rate is a ratio of an amount of toner transferred to the intermediate transfer body to an amount of toner per unit area on the image forming body before transferring.

Figure 2:
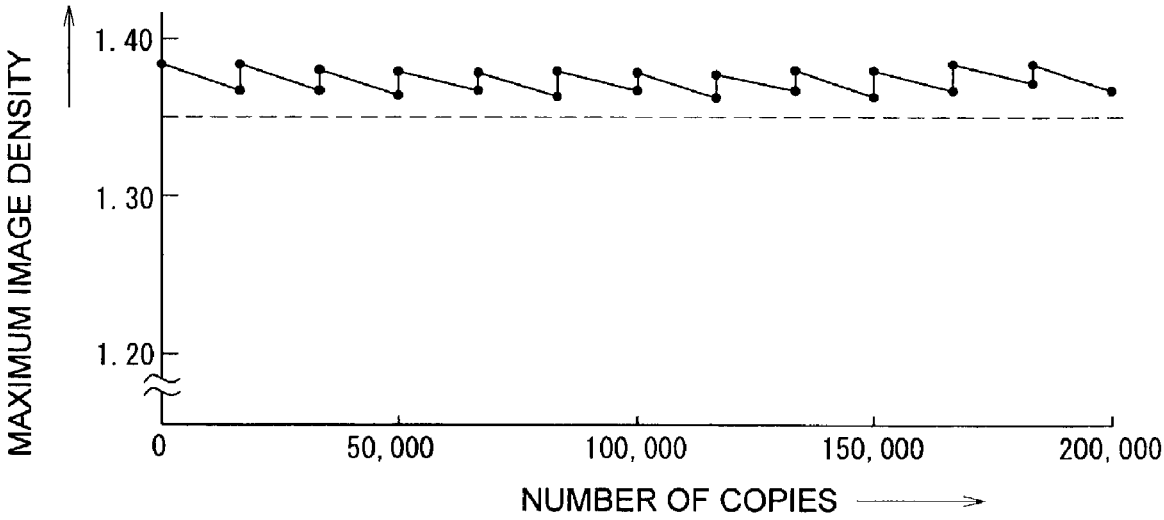
FIG. 2 is a diagram showing the transfer rate observed in copies up to 200,000 copies in Example 1.
Figure 3:
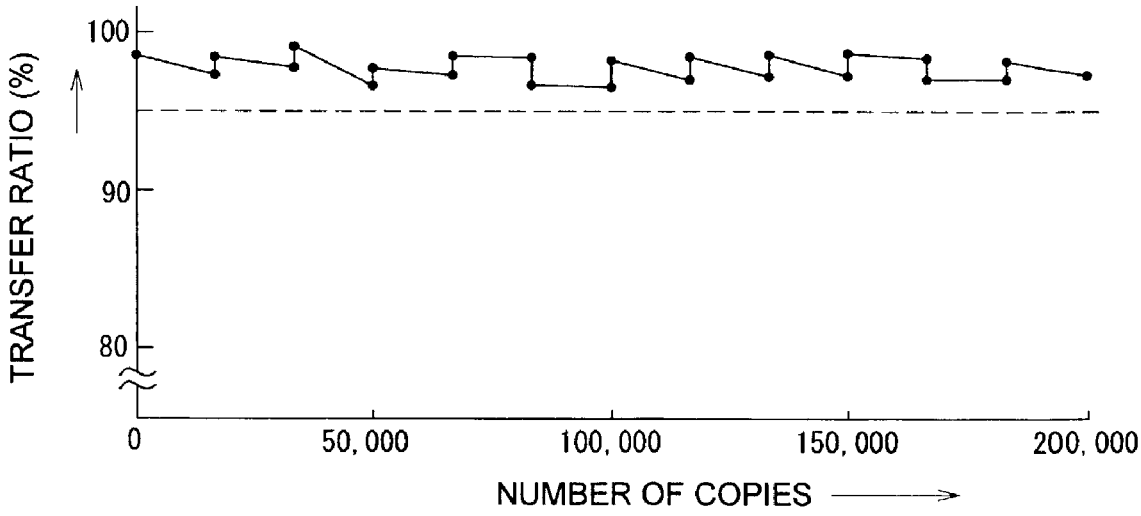
FIG. 3 is a diagram showing the highest image density observed in copies up to 200,000 copies in Example 1.

Results:

With respect to image quality, it was stable for all of 200,000 copies, and the highest image density was high and stable as shown in FIG. 2, and images free from image bleeding or free from image with void area were obtained. The transfer rate was 95% or more constantly as shown in FIG. 3, which was an excellent result. Incidentally, the reason of up-and-down movement on the lines in the diagram for the highest density and highest transfer rate is that the operation of the image forming apparatus was stopped momentarily at the moment in terms of the number of copies which have been made by that moment corresponding to the up-and-down movement in the diagram.

On the other hand, when toner whose variation coefficient of a shape factor exceeds 16% although its particle number average particle diameter is the same as the foregoing, or toner having variation coefficient in number particle size distribution that exceeds 27% was used, the transfer rate was 95% or less from the initial stage of the test, and it was lowered as copying operations were repeated. when toner having particle number average particle diameter of 8 μm was used, image quality was lower than that in the case where toner having particle number average particle diameter of 6 μm was used.

EXAMPLE 2

Figure 4:
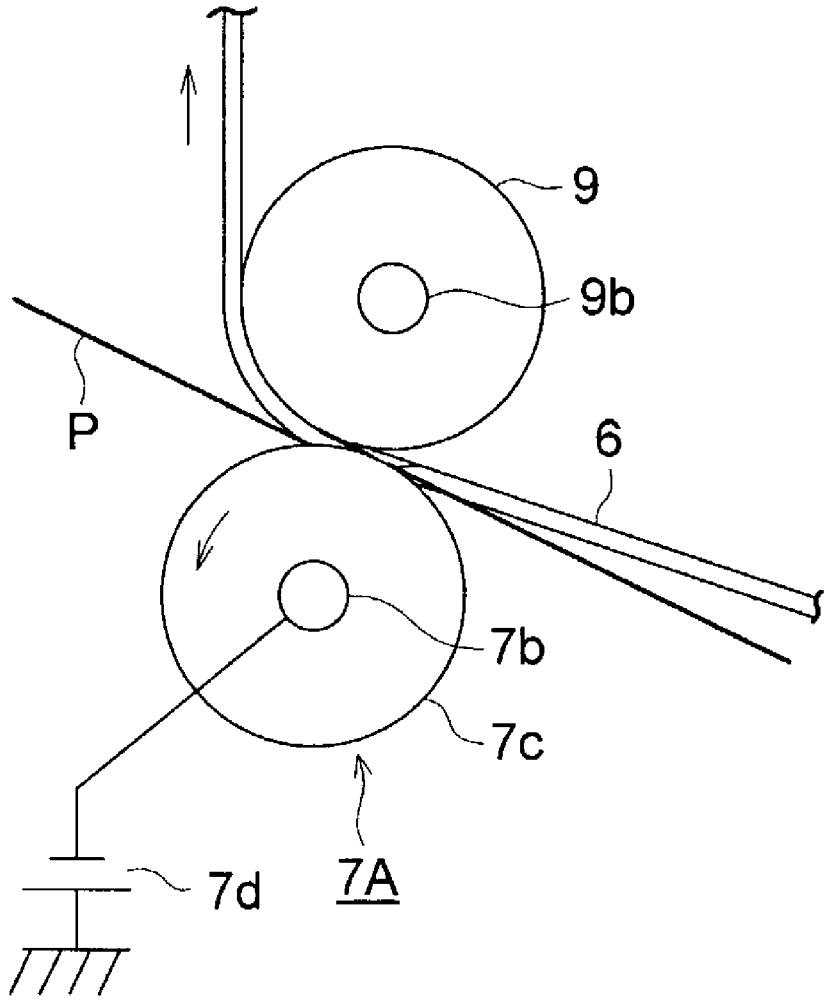
FIG. 4 is a schematic view of a secondary transfer roller section in Example 2.

There was used an image forming apparatus that is the same as the image forming apparatus in Example 1, and a foaming roller ($10^6$ Ω·cm) having a diameter of 20 mm was provided on the back side of the intermediate transfer body as the primary transfer body, while, an elastic body resin roller having a core metal as shown in FIG. 4 was brought into pressure contact with the surface of the intermediate transfer body to be impressed with electric field (control of constant-current to 80 μA). The symbol 7A represents a transfer roller that is a secondary transfer means, 7*b* represents a core metal made of stainless steel, 7*c* represents an elastic body made of urethane rubber and 7*d* represents a high voltage bias voltage power source. As stated above, P is an image support, 6 is an intermediate transfer body and 9 is a facing roller that presses the intermediate transfer body against secondary transfer means 7A from the rear side.

In Example 2, the conveyance speed of the intermediate transfer body was 210 mm/s, and there was used toner whose particle number average particle diameter was 6.5 μm and its variation coefficient was 21.

The results of Example 2 are shown in the following Table 1 together with the results of using those wherein the conveyance speed of the intermediate transfer body was 150 mm/s, and particle number average particle diameter of toner was made to be 8 μm (Comparative Examples 1, 2 and 3).

Transfer unevenness was judged by visual check, by using the image forming apparatus which has made 200,000 copies for the test.

TABLE 1

| Example, Comparative Example | Line Speed (mm/sec) | Primary transfer current (μA) | Particle number average particle diameter (μm) | Variation coefficient (%) | Sum of relative frequency | Shape factor Rate of 1.2–1.6 (%) | Variation coefficient of shape factor | Transfer rate | Primary transfer unevenness |
|---|---|---|---|---|---|---|---|---|---|
| Comparative Example 1 | 210 | 29 | 8 | 29 | 54 | 56 | 23 | 93 | C |
| Comparative Example 2 | 150 | 21 | 8 | 29 | 54 | 56 | 23 | 95 | A |

TABLE 1-continued

| Example, Comparative Example | Line Speed (mm/sec) | Primary transfer current (μA) | Particle number average particle diameter (μm) | Variation coefficient (%) | Sum of relative frequency | Shape factor Rate of 1.2–1.6 (%) | Variation coefficient of shape factor | Transfer rate | Primary transfer unevenness |
|---|---|---|---|---|---|---|---|---|---|
| Example 2 | 210 | 21 | 6.5 | 21 | 72 | 66 | 15 | 95 | A |
| Comparative Example 3 | 210 | 29 | 6.5 | 29 | 54 | 56 | 23 | 90 | C |

A: Unevenness was not observed.
C: Unevenness was observed in the image.

It is understood that Example 2 in the invention only has excellent characteristics.

EXAMPLE 3

There was used an image forming apparatus that is the same as the image forming apparatus in Example 2, and cleaning of a transfer roller in the secondary transfer means was conducted by the method wherein toner is transferred again onto the intermediate transfer body by electric field (control of constant-current to 30 μA) of reverse bias voltage impressed on the transfer roller.

The number of impressions of reverse bias voltage was ten in total including alternating positive and negative electric fields in a unit time which is required by the secondary transfer roller to make one turn. Incidentally, an amount of toner sticking to the secondary transfer roller before cleaning was 1.5 mg/cm$^2$.

The results of Example 3 are shown in the following Table 2 together with the results of using those wherein the conveyance speed of the intermediate transfer body was 150 mm/s, and particle number average particle diameter of toner was made to be 8 μm (Comparative Examples 4, 5 and 6).

Stains on the reverse side of the image support was judged by visual check, by using the image forming apparatus which has made 200,000 copies for the test.

TABLE 2

| Example, Comparative Example | Line speed (mm/sec) | Particle number average particle diameter (μm) | Variation coefficient (%) | Sum of relative frequency | Rate of shape factor | Shape factor Variation coefficient of 1.2–1.6 (%) | Amount of toner remaining on transfer toner (%) | Stains on reverse side of image support |
|---|---|---|---|---|---|---|---|---|
| Comparative Example 4 | 150 | 8 | 25 | 54 | 56 | 23 | 4.6 | C |
| Comparative Example 5 | 210 | 8 | 25 | 54 | 56 | 23 | 5.3 | C |
| Example 3 | 210 | 6.5 | 21 | 72 | 72 | 15 | 1.3 | A |
| Comparative Example 6 | 210 | 6.5 | 29 | 54 | 54 | 23 | 5.5 | C |

A: Stains were not observed.
C: Stains were observed.

It is understood that Example 3 in the invention only has excellent characteristics.

The invention makes it possible to keep the transfer rate for toner to be high for a long time, and to find out measures to solve the following problems.

Firstly, it is possible to provide an image forming apparatus wherein, when a toner image has already been transferred on a transfer material and a toner image is further transferred additionally on the aforesaid toner image, a condition that the toner image to be transferred additionally is transferred at a high transfer rate, and the toner which has already been transferred is not transferred again onto the image forming body is found out, and a scratch is not caused on the surface of the image forming body or the intermediate transfer body, and therefore, neither cleaning failure nor toner filming is caused.

Secondly, it is possible to provide an image forming apparatus wherein the process speed for transferring toner images is high, and high transfer efficiency can be obtained even when a value of an electric current to be impressed on a roller to prevent exfoliation discharge is lowered.

Thirdly, it is possible to provide an image forming apparatus wherein it is possible to return toner to an image carrier or to an intermediate transfer body by applying reverse bias voltage for the purpose of cleaning a transfer means, and to clean it for certain.

What is claimed is:

1. An image forming apparatus comprising:

an image forming body for forming a latent image and a toner image;

a developing device for developing with a toner the latent image formed on the image forming body to form the toner image;

a primary transfer device for transferring the toner image on the image forming body onto an intermediate transfer body; and a secondary transfer device for transferring the toner image on the intermediate transfer body onto an image support, wherein the primary transfer device comprises a conductive body or semi-conductive body, and is provided with a power supply unit for applying a bias voltage, and wherein a variation coefficient of a shape factor of the toner is 16% or less, and a number variation coefficient of a number particle size distribution of the toner is 27% or less.

2. The image forming apparatus of claim 1, wherein a particle number average particle diameter of the toner is 2–7 μm.

3. The image forming apparatus of claim 1, wherein a volume resistivity of the intermediate transfer body is $10^{3}$–$10^{13}$ Ω·cm.

4. The image forming apparatus of claim 1, wherein a plurality of color toner images are transferred to be superposed on the intermediate transfer body.

5. The image forming apparatus of claim 1, wherein the developing device is a two-component developing device for developing the latent image with two-component developer, which comprises a mixture of toner and carrier.

6. The image forming apparatus of claim 1, wherein the primary transfer device comprises an elastic roller having an elastic body mounted on a core metal, and the elastic roller is applied the bias voltage by the power supply unit.

7. An image forming apparatus comprising:

a plurality of image forming bodies for forming plural latent images;

a plurality of developing devices, wherein each of the plurality of developing devices develops a corresponding latent image in the plural latent images with each of plural toners to form plural toner images;

a plurality of primary transfer devices for transferring the plural toner images successively to be superposed on an intermediate transfer body; and a secondary transfer device for collectively transferring the plural toner images on the intermediate transfer body onto an image support, wherein a conveyance speed of the intermediate transfer body in the course of transferring is 200 mm/s or more, a number average particle size of each of the plural toners is 2–7 μm, and a number variation coefficient in a number particle size distribution of each of the plural toners is 27% or less, and wherein, in each of the plural toners, (m1) represents a relative frequency of toner particle included in a most frequent rank, and (m2) represents a relative frequency of toner particle included in a second highest rank in a histogram showing particle size distribution when a horizontal axis representing natural logarithm 1n (D) is divided into plural ranks at 0.23 intervals, wherein a sum (M) of (m1) and (m2) is 70% or more.

8. An image forming apparatus comprising:

a plurality of image forming bodies for forming plural latent images;

a plurality of developing devices, wherein each of the plurality of developing devices develops a corresponding latent image in the plural latent images with each of plural toners to form plural toner images;

a plurality of primary transfer devices for transferring the plural toner images successively to be superposed on an intermediate transfer body; and a secondary transfer device for collectively transferring the plural toner images on the intermediate transfer body onto an image support, wherein a conveyance speed of the intermediate transfer body in the course of transferring is 200 mm/s or more, a number average particle size of each of the plural toners is 2–7 μm, and a number variation coefficient in a number particle size distribution of each of the plural toners is 27% or less, and wherein in each of the plural toners, the number basis ratio of toner particles, whose shape factor of the toner is in a range of 1.2–1.6, is 65% or more, and a coefficient of variation of the shape factor is 16% or less.

9. An image forming apparatus comprising:

a plurality of image forming bodies for forming respective color latent images of yellow (Y), magenta (M), cyan (C) and black (K);

a plurality of developing devices for developing the respective color latent images with corresponding color toners to form respective color toner images;

a plurality of primary transfer devices for transferring the respective color toner images successively to be superposed on an intermediate transfer body; and a secondary transfer device for collectively transferring the color toner images on the intermediate transfer body onto an image support, wherein a number average particle size of each of the color toners is 2–7 μm, a number variation coefficient in a number particle size distribution of each of the color toners is 27% or less, wherein the secondary transfer device comprises a transfer roller, and a cleaning method of the transfer roller comprises transferring residual toners again onto the intermediate transfer body by means of an electric field, and wherein in each of the color toners, (m1) represents a relative frequency of toner particle included in a most frequent rank, and (m2) represents a relative frequency of toner particle included in a second highest rank in a histogram showing particle size distribution when a horizontal axis representing natural logarithm 1n (D) is divided into plural ranks at 0.23 intervals, wherein a sum (M) of (m1) and (m2) is 70% or more.

10. An image forming apparatus comprising:

a plurality of image forming bodies for forming respective color latent images of yellow (Y), magenta (M), cyan (C) and black (K);

a plurality of developing devices for developing the respective color latent images with corresponding color toners to form respective color toner images;

a plurality of primary transfer devices for transferring the respective color toner images successively to be superposed on an intermediate transfer body; and a secondary transfer device for collectively transferring the color toner images on the intermediate transfer body onto an image support, wherein a number average particle size of each of the color toners is 2–7 μm, and a number variation coefficient in a number particle size distribution of each of the color toners is 27% or less, wherein the secondary transfer device comprises a transfer roller, and a cleaning method of the transfer roller comprises transferring residual toners again onto the intermediate transfer body by means of an electric field, and wherein in each of the color toners, a number basis ratio of toner particles, whose shape factor of the toner is in a range of 1.2–1.6, is 65% or more, and a coefficient of variation of the shape factor is 16% or less.

11. An image forming apparatus comprising:

a plurality of image forming bodies for forming respective color latent images of yellow (Y), magenta (M), cyan (C), and black (K);

a plurality of developing devices for developing the respective color latent images with corresponding color toners to form respective color toner images;

a plurality of transfer devices for transferring the respective color toner images successively to be superposed on an image support, wherein a number average particle size of each of the color toners is 2–7 μm, and a number variation coefficient in a number particle size distribution of each of the color toners is 27% or less, wherein the plurality of transfer devices comprise transfer rollers and a cleaning method of the transfer roller comprises transferring residual toners again onto the intermediate transfer body by means of an electric field, and wherein in each of the color toners, (m1) represents a relative frequency of toner particle included in a most frequent rank, and (m2) represents a relative frequency of toner particle included in a second highest rank in a histogram showing particle size distribution when a horizontal axis representing natural logarithm 1n (D) is divided into plural ranks at 0.23 intervals, wherein a sum (M) of (m1) and (m2) is 70% or more.

12. An image forming apparatus comprising:

a plurality of image forming bodies for forming respective color latent images of yellow (Y), magenta (M), cyan (C) and black (K);

a plurality of developing devices for developing the respective color latent images with corresponding color toners to form respective color toner images;

a plurality of transfer devices for transferring the respective color toner images successively to be superposed on an image support, wherein a number average particle size of each of the color toners is 2–7 μm, and a number variation coefficient in a number particle size distribution of each of the color toners is 27% or less, wherein the plurality of transfer devices comprise transfer rollers and a cleaning method of the transfer roller comprises transferring residual toners again onto the intermediate transfer body by means of an electric field, and wherein in each of the color toners, a number basis ratio of toner particles, whose shape factor of the toner is in a range of 1.2–1.6, is 65% or more, and a coefficient of variation of the shape factor is 16% or less.

13. An image forming method comprising:

forming a latent image on an image forming body;

developing with a toner the latent image formed on the image forming body to form the toner image;

primarily transferring the toner image on the image forming body onto an intermediate transfer body; and secondary transferring the toner image on the intermediate transfer body onto an image support, wherein a bias voltage is applied to a primary transfer device comprising a conductive body or semi-conductive body, and wherein a variation coefficient of a shape factor of the toner is 16% or less, and a number variation coefficient of a number particle size distribution of the toner is 27% or less.

14. The image forming method of claim 13, wherein a particle number average particle diameter of the toner is 2–7 μm.

15. An image forming method comprising:

forming respective color latent images of yellow (Y), magenta (M), cyan (C) and black (K), on a plurality of image forming bodies;

developing the respective color latent images with corresponding color toners to form respective color toner images; primarily transferring the respective color toner images successively to be superposed on an intermediate transfer body; and collectively transferring the color toner images on the intermediate transfer body onto an image support by using a secondary transfer device, wherein a number average particle size of each of the color toners is 2–7 μm, and a number variation coefficient in a number particle size distribution of each of the color toners is 27% or less, wherein the second transfer device comprises a transfer roller, and a cleaning method of the transfer roller comprises transferring residual toners again onto the intermediate transfer body by means of electric field, and wherein in each of the color toners, (m1) represents a relative frequency of toner particle included in a most frequent rank, and (m2) represents a relative frequency of toner particle included in a second highest rank in a histogram showing particle size distribution when a horizontal axis representing natural logarithm 1n (D) is divided into plural ranks at 0.23 intervals, wherein a sum (M) of (m1) and (m2) is 70% or more.

16. An image forming method comprising:

forming respective color latent images of yellow (Y), magenta (M), cyan (C) and black (K), on a plurality of image forming bodies;

developing the respective color latent images with corresponding color toners to form respective color toner images;

primarily transferring the respective color toner images successively to be superposed on an intermediate transfer body; and collectively transferring the color toner images on the intermediate transfer body onto an image support by using a secondary transfer device, wherein a number average particle size of each of the color toners is 2–7 μm, and a number variation coefficient in a number particle size distribution of each of the color toners is 27% or less, wherein the second transfer device comprises a transfer roller, and a cleaning method of the transfer roller comprises transferring residual toners again onto the intermediate transfer body by means of electric field, and wherein in each of the color toners, a number basis ratio of toner particles, whose shape factor of the toner is in a range of 1.2–1.6, is 65% or more, and a coefficient of variation of the shape factor is 16% or less.

* * * * *